US009458810B2

(12) United States Patent
Novaco et al.

(10) Patent No.: US 9,458,810 B2
(45) Date of Patent: Oct. 4, 2016

(54) FUEL MODULE WITH ELECTROSTATIC DISCHARGE MITIGATION

(71) Applicant: GM Global Technology Operations LLC, Detroit, MI (US)

(72) Inventors: Richard A. Novaco, Bloomfield, MI (US); Mitchell E. Hart, Grand Blanc, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 913 days.

(21) Appl. No.: 13/760,357

(22) Filed: Feb. 6, 2013

(65) Prior Publication Data

US 2014/0216416 A1 Aug. 7, 2014

(51) Int. Cl.

| | |
|---|---|
| ***F02M 37/22*** | (2006.01) |
| ***F02M 37/10*** | (2006.01) |
| ***F02M 37/04*** | (2006.01) |
| ***F02M 37/00*** | (2006.01) |
| ***F02M 69/02*** | (2006.01) |
| *F02M 37/08* | (2006.01) |

(52) U.S. Cl.

CPC ..... *F02M 69/02* (2013.01); *F02M 37/106* (2013.01); *F02M 37/22* (2013.01); *F02M 2037/082* (2013.01); *F02M 2037/228* (2013.01); *Y10T 137/85978* (2015.04)

(58) Field of Classification Search

CPC ..... F02M 37/22; F02M 37/106; F02M 2037/082; F02M 2037/228; F02M 69/02; Y10T 137/85978

See application file for complete search history.

(56) References Cited

U.S. PATENT DOCUMENTS

| | | | | |
|---|---|---|---|---|
| 5,085,773 | A | 2/1992 | Danowski | |
| 5,156,783 | A * | 10/1992 | Seizert | C08J 7/14 264/233 |
| 5,164,084 | A | 11/1992 | Danowski et al. | |
| 5,380,432 | A * | 1/1995 | Brandt | B01D 39/18 210/243 |
| 5,382,359 | A * | 1/1995 | Brandt | B01D 27/08 210/243 |
| 6,004,462 | A | 12/1999 | Yamada et al. | |
| 2009/0230674 | A1 | 9/2009 | Villaire et al. | |
| 2010/0323109 | A1 * | 12/2010 | Hamilton | C23C 18/1608 427/256 |

* cited by examiner

*Primary Examiner* — Hieu T Vo
*Assistant Examiner* — Arnold Castro
(74) *Attorney, Agent, or Firm* — Lorenz & Kopf LLP

(57) ABSTRACT

Methods and apparatus are provided for electrostatic discharge mitigation for a fuel module. In one embodiment, the system includes a fuel pump having a power and ground connection for pumping fuel. A fuel filter in fluid communication with the fuel pump, the fuel filter including one or more components made of a non-conductive plastic and having a sulfonated surface covered with a conductive surface formed over the sulfonated surface. The conductive surface is electrically coupled to the vehicle ground plane. A method is provided for mitigation of electrostatic discharge in a fuel module. In one embodiment, the method includes sulfonating non-conductive plastic components of the fuel module to provide a sulfonated layer on the non-conductive plastic components and forming a conductive layer over the sulfonated layer to provide an electrical discharge path for electrostatic buildup resulting from fuel moving through the fuel module.

17 Claims, 3 Drawing Sheets

FUEL MODULE WITH ELECTROSTATIC DISCHARGE MITIGATION

TECHNICAL FIELD

The technical field generally relates to fuel delivery modules for motor vehicles that provide fuel from fuel reservoirs, and more particularly to fuel delivery modules capable of mitigating electrostatic discharge resulting from fuel flow through the fuel module.

BACKGROUND

It is known that conduit structures that are exposed to turbulent fuel flow may, under some circumstances, acquire an electrostatic (or static electric) charge. Left unabated, electrostatic charge buildup can lead to spontaneous discharge if and when the charge exceeds the breakthrough voltage between the charged element and nearest ground which may ultimately lead to failure of the conduit requiring replacement. Accordingly, it is common to provide a conductive path to the vehicle ground plane to discharge any static charge that may be developed in conduits such as fuel delivery modules for vehicles. Plastic materials employed for fuel delivery module, such as polyoxymethylene (POM), are generally not conductive and so are typically combined or impregnated with conductive additives (such as carbon powders, carbon fibers or stainless steel fibers) to increase conductivity. These additives generally reduce the tensile or creep strength of the material and may react differently when exposed to environmental input such as heat and fuel compared to the base plastic. Further, these materials may be higher cost and require more complex processing. Accordingly, it is preferred to minimize the use of these conductive additives.

Accordingly, due to its lower cost and higher strength it is desirable to use non-conductive polyoxymethylene in fuel modules for vehicles. In addition, it is desirable to use a non-conductive polyoxymethylene that can be made conductive without a reduction in material strength or performance. Furthermore, other desirable features and characteristics of the present invention will become apparent from the subsequent detailed description and the appended claims, taken in conjunction with the accompanying drawings and the foregoing technical field and background.

SUMMARY

A system is provided for a fuel delivery module with electrostatic discharge mitigation. In one embodiment, the system includes a fuel pump having a power and ground connection for pumping fuel. A fuel filter in fluid communication with the fuel pump, the fuel filter including one or more components made of a non-conductive plastic and having a sulfonated surface covered with a conductive surface formed over the sulfonated surface. The conductive surface is electrically coupled to the ground connection of the fuel pump (or other suitable connection to the vehicles ground plane). The system includes a fuel exit port in fluid communication with the fuel filter, the fuel exit port being formed from a non-conductive plastic having a sulfonated interior surface with a conductive surface formed over the sulfonated interior surface and also electrically coupled to the ground connection of the fuel pump.

A method is provided for mitigation of electrostatic discharge in a fuel module. In one embodiment, the method includes sulfonating non-conductive plastic components of the fuel delivery module to provide a sulfonated layer on the non-conductive plastic components and forming a conductive layer over the sulfonated layer to provide an electrical discharge path for electrostatic buildup resulting from fuel moving through the fuel module.

DESCRIPTION OF THE DRAWINGS

The exemplary embodiments will hereinafter be described in conjunction with the following drawing figures, wherein like numerals denote like elements, and wherein.

DETAILED DESCRIPTION

The following detailed description is merely exemplary in nature and is not intended to limit the application and uses. Furthermore, there is no intention to be bound by any expressed or implied theory presented in the preceding technical field, background, brief summary or the following detailed description.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language.

Additionally, the following description refers to elements or features being "connected" or "coupled" together. As used herein, "connected" may refer to one element/feature being directly joined to (or directly communicating with) another element/feature, and not necessarily mechanically. Likewise, "coupled" may refer to one element/feature being directly or indirectly joined to (or directly or indirectly communicating with) another element/feature, and not necessarily mechanically. However, it should be understood that, although two elements may be described below, in one embodiment, as being "connected," in alternative embodiments similar elements may be "coupled," and vice versa. Thus, although the schematic diagrams shown herein depict example arrangements of elements, additional intervening elements, devices, features, or components may be present in an actual embodiment.

Finally, for the sake of brevity, conventional techniques and components related to vehicle electrical and mechanical parts and other functional aspects of the system (and the individual operating components of the system) may not be described in detail herein. Furthermore, the connecting lines shown in the various figures contained herein are intended to represent example functional relationships and/or physical couplings between the various elements. It should be noted that many alternative or additional functional relationships or physical connections may be present in an embodiment of the invention. It should also be understood that FIGS. 1-3 are merely illustrative and may not be drawn to scale.

Figure 1:
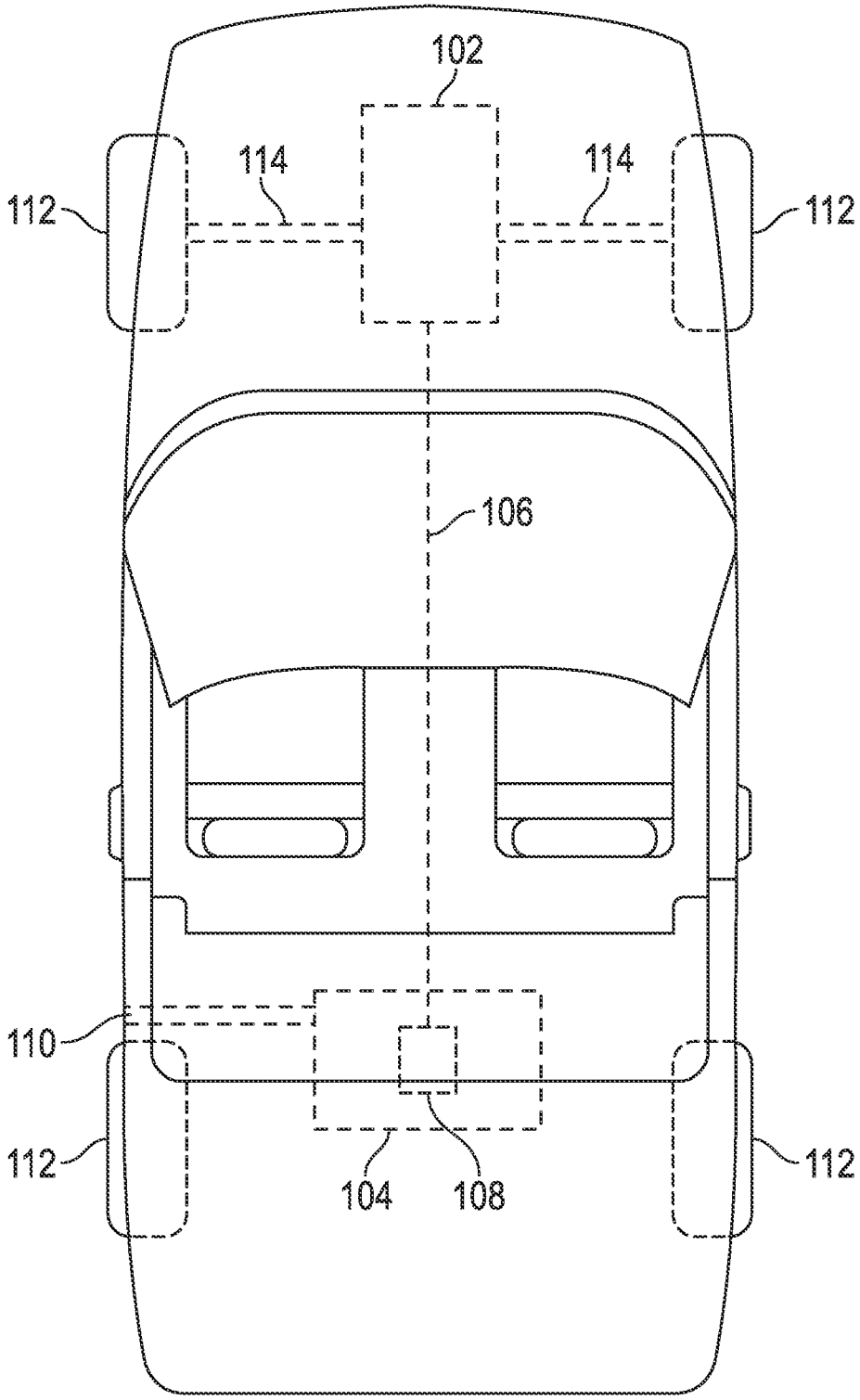
FIG. 1 is an illustration of a vehicle in accordance with an embodiment.

Referring to the drawings, wherein like reference numbers refer to like components, FIG. 1 shows a vehicle 100 according to exemplary embodiments. In addition to the illustrated vehicle, the vehicle 100 may be any one of a number of different types of vehicles, such as, for example, air craft, water craft, motorcycle, off-road vehicles, or other motor vehicles including a sedan, a wagon, a truck, or a sport utility vehicle (SUV), and may be two-wheel drive (2WD), four-wheel drive (4WD), or all-wheel drive (AWD).

In FIG. 1 the simplified illustrated embodiment of vehicle 100 includes, without limitation: a vehicle engine 102 coupled to a fuel reservoir 104 via a fuel conduit 106. The engine 102 may be any one of, or combination of, a number of different types of engines, such as, for example, a gasoline or diesel fueled combustion engine, a flex fuel vehicle (FFV) engine (i.e., using a mixture of gasoline and alcohol), a gaseous compound (e.g., hydrogen and/or natural gas) fueled engine, a combustion/electric motor hybrid engine, and an electric motor. Fuel is provided to the engine 102 via the fuel conduit 106 from a fuel module 108. Fuel may be added to the fuel reservoir from time to time via a fill tube 110. During operation, the engine 102 drives wheels 112 via drive shafts 114 to propel the vehicle 100.

Figure 2:
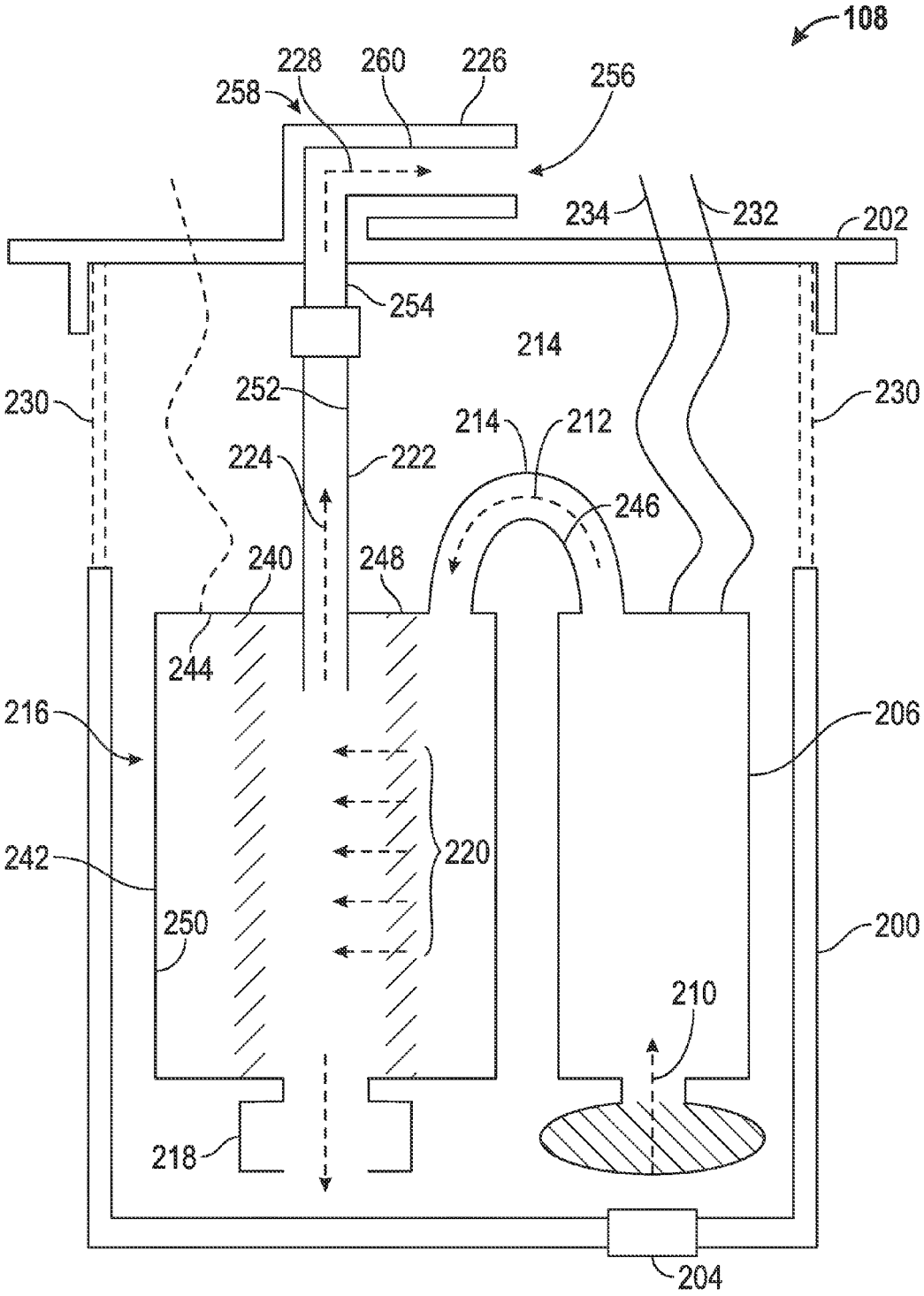
FIG. 2 is an illustration of a fuel module in accordance with an embodiment.
Figure 3:
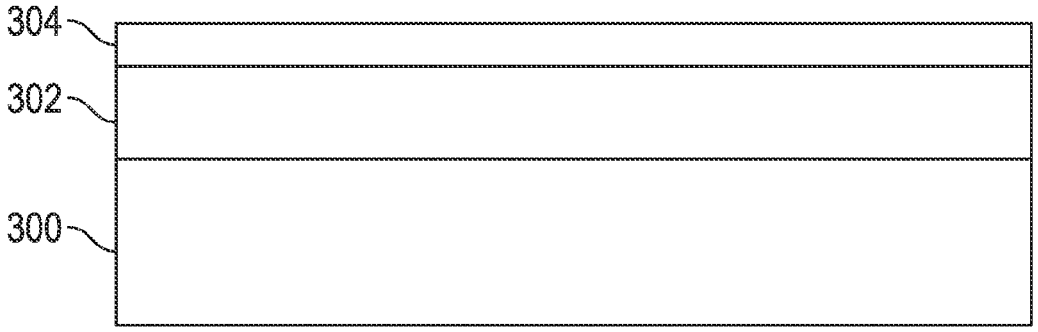
FIG. 3 is an illustration of a process for forming sulfonation and conductive layers on components of the fuel module in accordance with an embodiment.

Referring now to FIG. 2, a schematic diagram of the fuel module 108 of FIG. 1 is shown in accordance with various embodiments. The fuel module 108 may include a fuel pump, fuel filter, pressure regulator, and other components, and may be housed in a plastic housing 200 and a module cover 202 which provides for sealing the fuel module into the fuel tank. Fuel enters the housing 200 (if used in a particular implementation) from the fuel reservoir (not shown in FIG. 2) via a one-way valve 204 (e.g., a check valve). Although illustrated as positioned on the bottom of the housing 200, it will be appreciated that the check valve could be positioned in other locations on the housing 200. A fuel pump 206 draws fuel through a fuel strainer 208 as indicated by the fuel flow arrow 210. The pumped fuel (indicated by arrow 212) is then sent via a connector conduit 214 to a fuel filter 216. A pressure relief valve 218 is located on the fuel filter 216 which opens to maintain pressure to a limit determined according to the implemented embodiment. The filtered fuel (indicated by arrows 220) passes through a filter conduit 222 as indicated by arrow 224 to a fuel exit port 226 from which the fuel (indicated by arrow 228) is delivered to the engine (102 in FIG. 1) via the fuel conduit 106 (in FIG. 1). The fuel exit port 226 is sealingly connected with the cover 202 which, in turn, sealingly seated to the housing 200. In some embodiments, guide rods 230 guidably interconnect the cover 202 with the housing 200.

In order to supply electricity to operate the fuel pump 206 a power lead 232 (or series of leads) and a ground (or chassis) lead 234 are provided for the fuel pump 206. As noted above, conduits or surfaces exposed to turbulent fuel flow may, under some circumstances, acquire an electrostatic (or static electric) charge. Left unabated, electrostatic charge buildup can lead to spontaneous discharge if and when the charge exceeds the breakthrough voltage between the charged element and nearest ground which may ultimately lead to failure of the exposed components requiring replacement. A conductive path to the vehicle ground plane is provided to discharge any static charge that may be developed. In some embodiments, this conductive path is provided from the ground lead 243 that is coupled to the fuel pump 206. The conduit 214 is made conductive, which provides a ground path to the fuel filter 216. In some embodiments, the fuel filter is provided with a discharge to ground path via an optional ground lead 236.

Accordingly to exemplary embodiments, various components of the fuel module 108 are formed of non-conductive polyoxymethylene (POM) and made conductive via a sulfonation process prior to forming a conductive layer over a sulfonation layer formed on the component by the sulfonation process that will be discussed in detail in connection with FIG. 3. Normally, non-conductive polyoxymethylene does not adhere or bond to conductive layers, causing the use of conductive fibers, powders or other additives throughout the base plastic matrix. However, the sulfonation process facilitates bonding conductive material to the surface of the non-conductive polyoxymethylene, permitting this material to support discharging electrostatic buildup in embodiments of the fuel module 108.

Referring now to FIG. 3, an exemplary portion of a component of the fuel module 108 is shown. While any component of the fuel module 108 could employ this process, typically, some of the components of the fuel module 108 are made of various materials and by various processes, and may not need to use the sulfonation and conductive layer process according to exemplary embodiments. Those components (and/or the surfaces thereof) that could particularly benefit from the sulfonation and conductive layer process will be discussed below in connection with FIG. 4.

In some embodiments, the base material 300 of a component of the fuel module 108 is made of non-conductive polyoxymethylene (POM). As used herein sulfonation refers to a process by which a component is exposed to an atmosphere of sulfur-dioxide or sulfur-trioxide sufficient to form a sulfonation layer 302 on the base material 300. After the sulfonation process, a conductive layer 304 may be applied over the sulfonation layer 302 via conventional plating, sputtering or vapor deposition techniques. In some embodiments, the conductive layer is formed of a fuel compatible material such as tin, nickel, gold or palladium.

With reference back to FIG. 2, a variety of components of the fuel delivery module 108 can benefit from the process of FIG. 3. Typically, those components coming into contact with increased fuel turbulence could particularly benefit from the embodiments of the present disclosure. For example, the fuel filter 216 includes a filter cover 240 and filter housing 242. The interior surface 244 of the filter cover 240 typically experiences fuel applied under the pressure provided by the fuel pump 206, which may be a turbulent flow. In some embodiments a ground discharge path is provided by the connector conduit 214 to the ground lead 234 of the fuel pump 206. However, the connector conduit may be an extruded part made of polyamide, polyethylene, POM, or Polyvinylidene fluoride (PVDF) that can be made conductive via conventional coextruded multilayer construction techniques where the inner layer is compounded with conductive additives as described above. However, if the connector conduit 214 were made of non-conductive polyoxymethylene, the interior surface 246 could be sulfonated and have a conductive layer applied. In some embodiments, a ground discharge path may be provided to the fuel filter 216 via a direct ground lead 236. In such embodiments, it would be useful for the exterior surface 248 of the filter cover 240 to also be sulfonated and made conductive as discussed in connection with FIG. 3. In some embodiments, the interior surface 250 of the filter housing 402 could benefit from the sulfonation and conductive layering process of FIG. 3.

Another component experiencing high fuel flow that may cause turbulence is the filter conduit 222. In some embodiments, the filter conduit 222 is an extruded component made of polyamide, polyethylene, POM, or Polyvinylidene fluoride (PVDF) that can be made conductive via conventional coextruded multilayer construction techniques where the inner layer is compounded with conductive additives as described above. However, if the filter conduit 222 were made of non-conductive polyoxymethylene, the interior surface 252 could be sulfonated and have a conductive layer applied.

Still another component experiencing high fuel flow that may lead to turbulence is the fuel exit port 226. In some embodiments, the fuel port 226 is formed as an elbow having an inlet 254, and outlet 256 and an angled portion 258. This configuration may cause fuel flowing through the fuel exit port 226 to experience a 90 degree change in direction. Thus, there is an increased possibility for fuel flow turbulence to develop within the fuel exit port 226. Accordingly, the interior surface 260 (or at least the portion thereof forming the angled portion 258) could be sulfonated and have a conductive layer applied.

Accordingly, an improved fuel module is provided for a vehicle having electrostatic buildup discharge protection. The sulfonation process allows a conductive layer to be applied over materials such as non-conductive polyoxymethylene without causing the material to become brittle or difficult to mold. The sulfonation and conductive layering process may be used selectively on some components or component surfaces as it is electrically compatible with other components made conductive via conventional techniques.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the appended claims and the legal equivalents thereof.

What is claimed is:

1. A system, comprising:

a fuel pump having a power and ground connection for pumping fuel;

a fuel filter in fluid communication with the fuel pump, the fuel filter including one or more components of a non-conductive plastic having a sulfonated surface with a conductive surface formed over the sulfonated surface and electrically coupled to the ground connection of the fuel pump; and a fuel exit port in fluid communication with the fuel filter, the fuel exit port being formed from a non-conductive plastic having a sulfonated interior surface with a conductive surface formed over the sulfonated interior surface and electrically coupled to the ground connection of the fuel pump.

2. The system of claim 1, further comprising:

a housing containing the fuel pump and the fuel filter;

a housing cover having the fuel exit port positioned therein.

3. The system of claim 2, further comprising a connector conduit between the fuel pump and the fuel filter, the connector conduit being formed of a non-conductive plastic having a sulfonated surface with the conductive surface formed over the sulfonated surface and electrically coupled to the ground connection of the fuel pump.

4. The system of claim 1, wherein the fuel filter comprises:

a filter housing formed of the non-conductive plastic having the sulfonated surface;

a filter housing cover formed of the non-conductive plastic having the sulfonated surface and having the conductive surface applied to an interior sulfonated surface thereof.

5. The system of claim 4, wherein the conductive surface is also applied to an interior sulfonated surface of the filter housing.

6. The system of claim 1, wherein the fuel exit port is formed in an elbow configuration having an inlet and an outlet on either side of an angled portion.

7. The system of claim 6, wherein the fuel exit port has the conductive surface formed over the sulfonated interior surface from the inlet through the angled portion.

8. The system of claim 6, wherein the fuel exit port has the conductive surface formed over the sulfonated interior surface from the inlet through the outlet.

9. The system of claim 1, further comprising a filter conduit between the fuel filter and fuel exit port, the filter conduit being formed of a non-conductive plastic having a sulfonated surface with the conductive surface formed over the sulfonated surface and electrically coupled to a ground connection.

10. A vehicle, comprising:

a combustion engine;

a fuel reservoir containing fuel for the combustion engine and configured to receive a fuel module comprising;

a fuel pump having a power and ground connection for pumping fuel from the fuel reservoir to the combustion engine;

a fuel filter in fluid communication with the fuel pump, the fuel filter including one or more components of a non-conductive plastic having a sulfonated surface with a conductive surface formed over the sulfonated surface and electrically coupled to the ground connection of the fuel pump;

a fuel exit port in fluid communication with the fuel filter, the fuel exit port being formed from a non-conductive plastic having a sulfonated interior surface with a conductive surface formed over the sulfonated interior surface and electrically coupled to the ground connection of the fuel pump; and a fuel conduit coupling the fuel exit port of the fuel module to the combustion engine.

11. The vehicle of claim 10, further comprising:

a housing containing the fuel pump and the fuel filter;

a housing cover having the fuel exit port positioned therein.

12. The vehicle of claim 11, a connector conduit between the fuel pump and the fuel filter, the connector conduit being formed of a non-conductive plastic having a sulfonated surface with the conductive surface formed over the sulfonated surface and electrically coupled to the ground connection of the fuel pump.

13. The vehicle of claim 10, wherein the fuel filter comprises:

a filter housing formed of the non-conductive plastic having the sulfonated surface;

a filter housing cover formed of the non-conductive plastic having the sulfonated surface and having the conductive surface applied to an interior sulfonated surface thereof.

14. The vehicle of claim 13, wherein the conductive surface is also applied to an interior sulfonated surface of the filter housing.

15. The vehicle of claim 10, wherein the fuel exit port is formed in an elbow configuration having an inlet and an outlet on either side of an angled portion.

16. The vehicle of claim 15, wherein the sulfonated surface of the fuel exit port extends from the inlet through at least the angled portion thereof.

17. The system of claim 10, further comprising a filter conduit between the fuel filter and fuel exit port, the filter conduit being formed of a non-conductive plastic having a sulfonated surface with the conductive surface formed over the sulfonated surface and electrically coupled to a ground connection.

* * * * *